US005399013A

United States Patent [19]

Sawyer

[11] Patent Number: 5,399,013

[45] Date of Patent: Mar. 21, 1995

[54] MIXING DEVICE

[76] Inventor: Michael A. Sawyer, 11426 Smokethorn Dr., Riverview, Fla. 33569

[21] Appl. No.: 206,601

[22] Filed: Mar. 7, 1994

[51] Int. Cl.[6] ..... B01F 11/00

[52] U.S. Cl. ..... 366/211; 366/110; 366/111; 366/213

[58] Field of Search ..... 366/110, 111, 208, 209, 366/210, 211, 213

[56] References Cited

U.S. PATENT DOCUMENTS

| | | | |
|---|---|---|---|
| 3,061,280 | 10/1962 | Kraft | 366/110 |
| 3,159,384 | 12/1964 | Davis | 366/110 |
| 4,555,183 | 11/1985 | Thomas | 366/208 |
| 4,747,693 | 5/1988 | Kahl | 366/208 |
| 4,883,644 | 11/1989 | Perlman | 366/110 |
| 4,943,164 | 7/1990 | Ohishi | 366/110 |
| 5,195,825 | 3/1993 | Ringrose | 366/110 |
| 5,238,302 | 8/1993 | Rohan | 366/110 |
| 5,273,357 | 12/1993 | Currie | 366/110 |

*Primary Examiner*—David A. Scherbel
*Assistant Examiner*—Terrence R. Till
*Attorney, Agent, or Firm*—A. W. Fisher, III

[57] ABSTRACT

A mixing device for mixing at least one liquid container of nail polish or other liquid comprising a housing to operatively house a container support to support the liquid container thereon disposed in the lower portion thereof coupled to a rotational drive to selectively rotate the container support, a lower container limit to selectively engage the lower portion of the liquid container and an upper container limit to selectively engage the upper portion of the liquid container such that as the container support is rotated about the vertical axis both the lower portion and upper portion of the liquid container translate laterally from the vertical axis to engage the lower container limit and upper container limit respectively creating a wobbling motion to shake and spin the liquid container to thoroughly and rapidly mix the liquid therein.

22 Claims, 3 Drawing Sheets

MIXING DEVICE

BACKGROUND OF THE INVENTION

1. Field of the Invention

A mixing device for mixing a liquid container of nail polish or other liquid.

2. Description of the Prior Art

Numerous devices have been developed to stir or shake liquid containers to mix liquid contained therein.

U.S. Pat. No. 4,555,183 discloses the use of an eccentrically rotating cylinder having a cup to receive the lower portion of a laboratory test tube in a V-shaped depression.

U.S. Pat. No. 5,238,302 describes a mixing machine for mixing nail polish and other liqudis. The mixing machine has a vibrating head assembly comprising a resilient bonnet with a series of openings to receive bottles or other containers of nail polish or other liquids. The machine includes an eccentrically weighted shaft driven by a motor which provides a vibrating driver to vibrate the bonnet and rotate the bottles so as to uniformly mix the nail polish or other liquids without forming air bubbles and foam.

U.S. Pat. No. 4,834,548 shows an apparatus for mixing a paint can comprising a frame and vertically oriented package holder. The package holder includes a device for releasably clamping a package so that the axis of the package is parallel with the axis of the holder. The apparatus also includes a device for driving the holder in a closed movement path relative to the frame. The holder is mounted such that its axis converges toward the drive shaft axis in the direction toward the upper portion of the holder.

U.S. Pat. No. 4,848,917 teaches a vortexing mixer drive having a rotatable coupling rod with an off-center countersink with a bore at the center of the countersink.

U.S. Pat. No. 4,555,183 describes a laboratory mixer including a test tube supporting cup means that translates in a circular path without rotating thereby creating an effective vortex in the materials in the test tube. The cup is allowed to translate in a circular path but is prevented from rotating by a restraining means that includes a restraining arm rotatably attached to the housing and a side arm connecting the restraining arm to the cup supporting shaft.

U.S. Pat. No. 5,121,991 shows a stirring device comprising a rack to hold a receptacle containing liquid, a rotor to rotate the receptacle and an oscillator to oscillate the rack. The fluid in the receptacle is uniformly stirred by oscillation imparted by the oscillator and by rotation imparted by the rotor.

U.S. Pat. No. 5,044,428 teaches a heater/mixer device including a chamber for use with laboratory vials, test tubes, or similar containers containing liquids. The vial fits loosely in the chamber. Compressed air passes into the chamber through an inlet in the block so that the vial is revolved by a circular air flow in a vortex fashion. The revolving motion creates a vortex in the liquid inside the vial, and so mixes the liquid.

U.S. Pat. No. 5,104,231 describes an apparatus for providing linear motion in two opposed directions and circular motion in a first direction using a single drive motor.

SUMMARY OF THE INVENTION

The present invention relates to a mixing device to mix a liquid container of nail polish or other liquid comprising a housing to operatively house a container support to support the liquid container thereon coupled to a rotational drive means to rotate the container support 16 and a lateral limit means to engage the liquid container such that as the container support is rotated the liquid container translates laterally from the vertical axis to engage the lateral limit means to create a wobbling motion to shake and spin the liquid container to thoroughly and rapidly mix the liquid therein.

The lateral limit means comprises a lower container limit and an upper container limit.

The lower container limit comprises a lower limit member extending upwardly from the container support and a lower resilient ring or annular member including a centrally disposed channel to receive the lower portion of the liquid container.

The upper container limit comprises a cover including a lower annular enlarged skirtand an upper cap including a reduced upper annular wall extending upwardly from the upper portion of the lower annular enlarged skirt with a substantially horizontal lip with a centrally disposed aperture formed therethrough extending inwardly therefrom with an upper resilient ring or annular member including a centrally disposed channel having a diameter less than the diameter of the centrally disposed aperture to receive the upper portion of the liquid container.

To use, the cover is removed from the lower container limit to allow placement of the enlarged lower portion of the liquid container to be placed in the centrally disposed channel. When so positioned, the cover is placed on the lower container limit with the reduced upper portion of the liquid container disposed within the centrally disposed channel.

In use, the switch is moved to the on position so that the rotational drive means rotates the container support and liquid container. The lower container limit engages the enlarged lower portion of the liquid container and the upper container limit to engage the reduced upper portion of the liquid container such that as the container support is rotated about the vertical axis movement of the enlarged lower portion and reduced upper portion of the liquid container laterally from the vertical axis is limited to create a wobbling motion to shake and spin the liquid container to thoroughly and rapidly mix the liquid.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
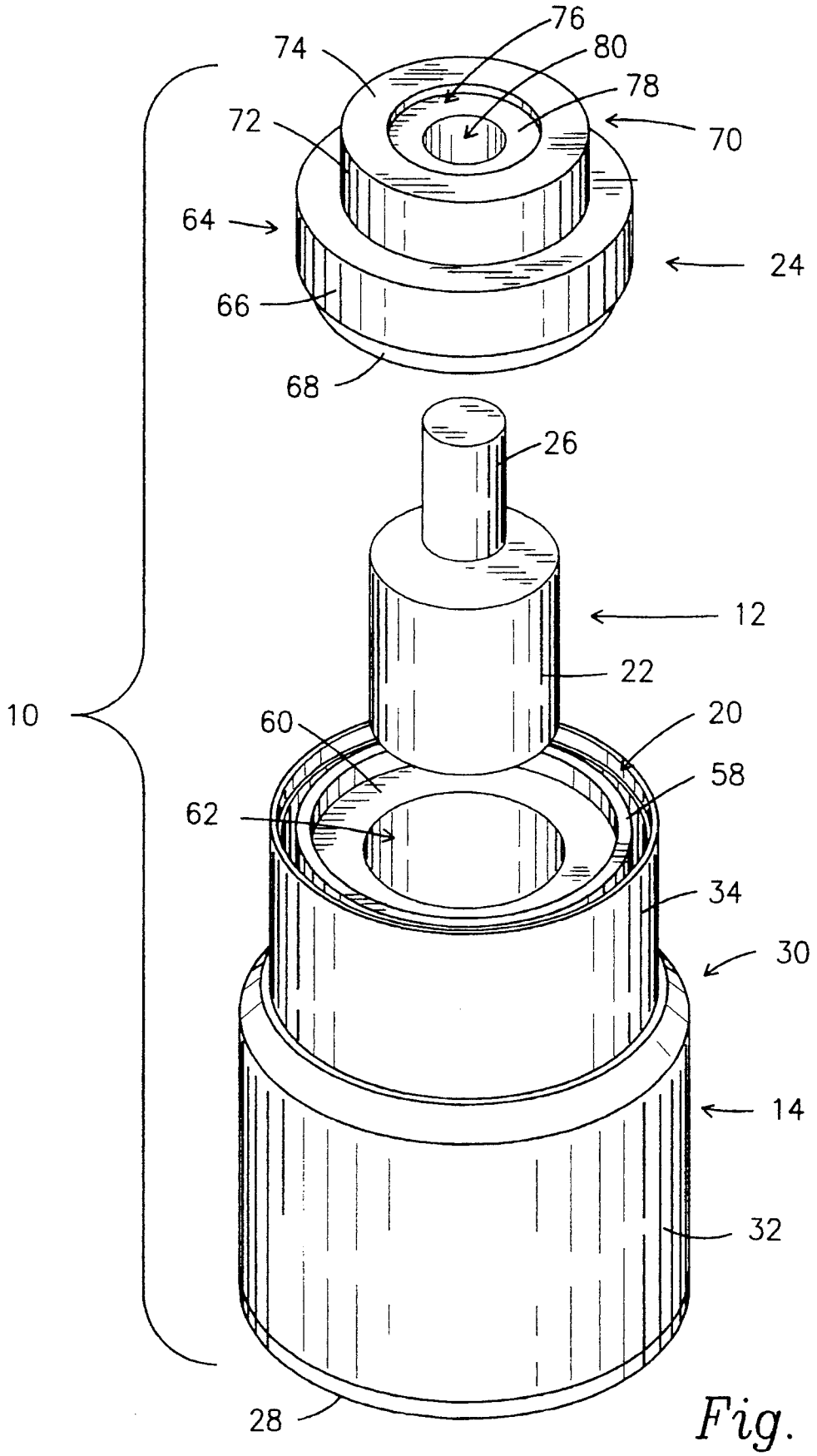
FIG. 1 is an exploded isometric view of the mixing device of the present invention.

As shown in FIGS. 1 through 5, the present invention relates to a mixing device generally indicated as 10 for mixing at least one liquid container of nail polish generally indicated as 12 or other liquid comprising a housing generally indicated as 14 to operatively house a container support generally indicated as 16 to support the liquid container 12 thereon coupled to a rotational drive means generally indicated as 18 to selectively rotate the container support 16, a lower container limit generally indicated as 20 to selectively engage the enlarged lower portion 22 of the liquid container 12 and an upper container limit generally indicated as 24 to selectively engage the reduced upper portion 26 of the liquid container 12 as the container support 16 is rotated about the vertical axis A such that the enlarged lower portion 22 and reduced upper portion 26 of the liquid container 12 translate laterally from the vertical axis A as depicted by lines B to engage the lower container limit 20 and upper container limit 24 respectively creating a wobbling motion to shake and spin the liquid container 12 to thoroughly and rapidly mix the liquid therein as described more fully hereinafter.

Figure 3:
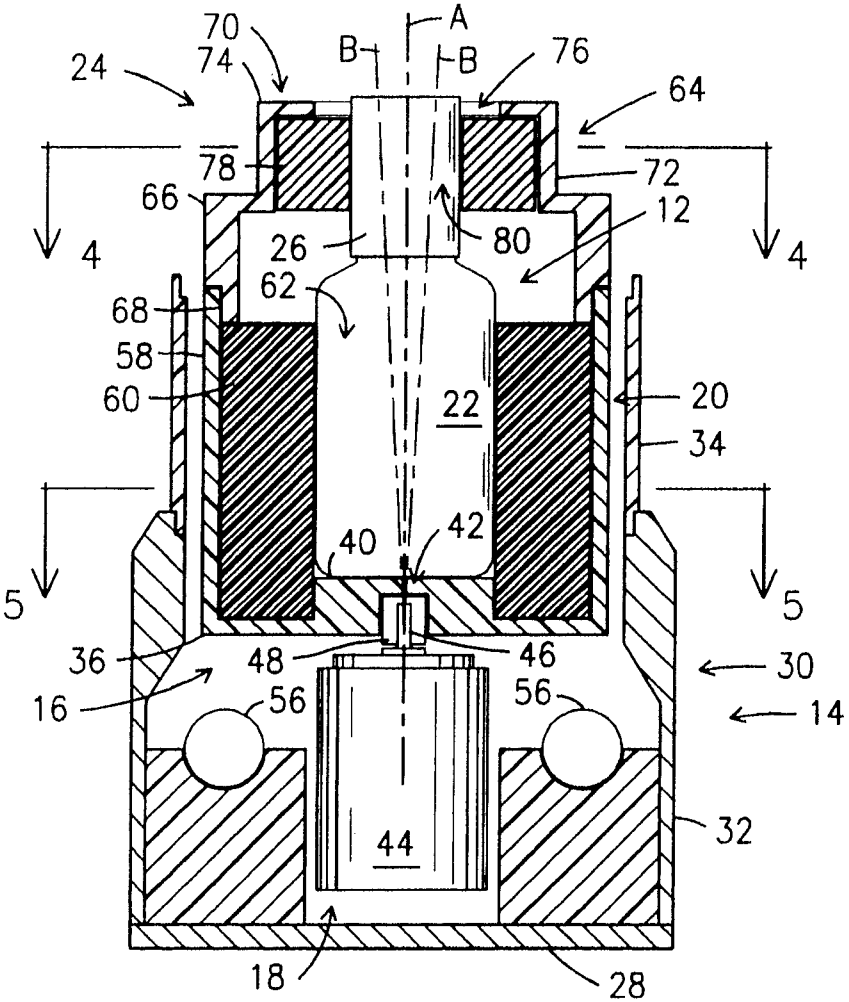
FIG. 3 is a cross-sectional front view of the mixing device of the present invention.
Figure 2:
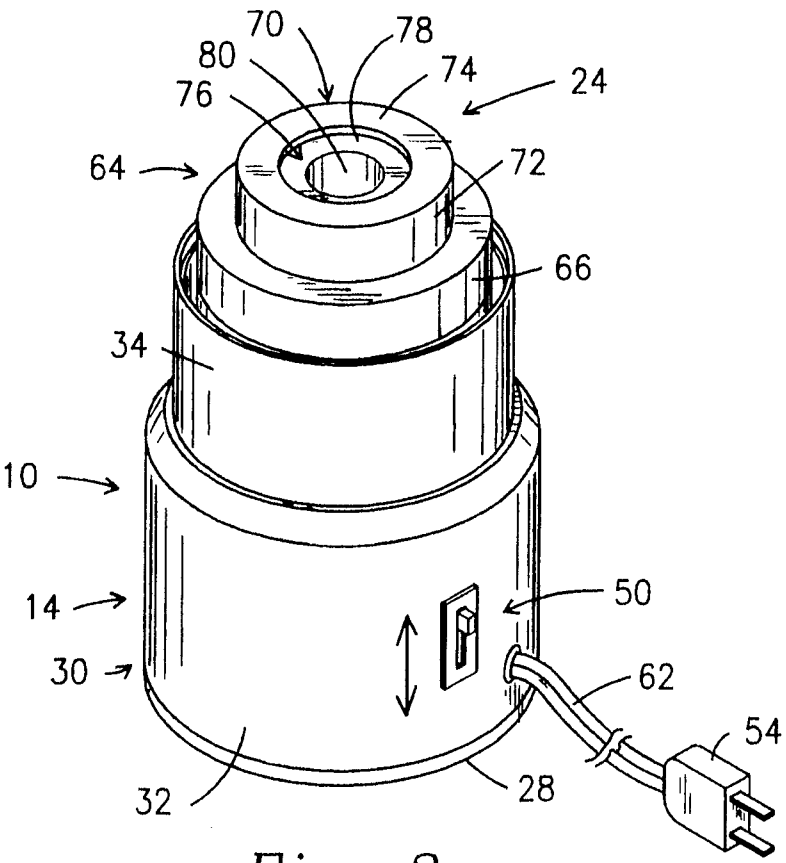
FIG. 2 is an isometric view of the mixing device of the present invention.

As best shown in FIGS. 1 through 3, the housing 14 comprises a base 28 having a substantially cylindrical vertical side wall generally indicated as 30 extending upwardly therefrom including an enlarged lower substantially cylindrical side wall portion 32 and a reduced upper substantially cylindrical side wall portion 34.

As best shown in FIG. 3, the container support 16 comprises a substantially horizontal support platform 36 having a centrally disposed support member 38 including a container support surface 40 extending upwardly therefrom and a centrally disposed recess 42 formed through the container support surface 40 and into the lower portion of the centrally disposed support member 38.

As best shown in FIGS. 2 and 3, the rotational drive means 18 comprises an electric motor 44 including a vertically disposed drive shaft 46 operatively supporting the container support 16 with a drive shaft coupler 48 press fitted into the centrally disposed recess 42. Operation of the electric motor 44 is controlled by a switch generally indicated as 50 as shown in FIG. 2 movable between a first and second position or an on and off position electrically coupled to the electric motor 44. As shown in FIG. 2, the switch 50 may be coupled to an external AC electric power source (not shown) through a conductor 52 and plug 54. Alternately as shown in FIG. 3, the switch 46 may be coupled to one or more DC batteries 56.

Figure 5:
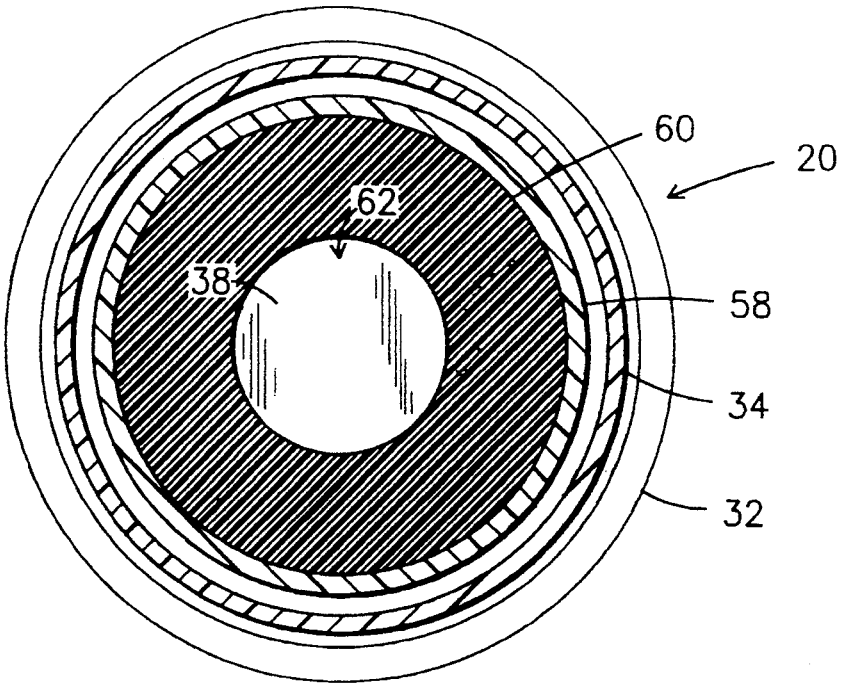
FIG. 5 is a cross-sectional top view of the mixing device taken along line 5—5 of FIG. 3.

As best shown in FIGS. 1, 3 and 5, the lower container limit 20 comprises a substantially vertical cylindrical lower limit member 58 extending upwardly from the substantially horizontal support platform 36 disposed in spaced relationship relative to the centrally disposed support member 38 and a substantially vertical disposed lower resilient ring or annular member 60 including a centrally disposed channel 62 to receive the lower portion 22 of the liquid container 12 disposed between the substantially vertical cylindrical lower limit member 58 and the centrally disposed support member 38.

Figure 4:
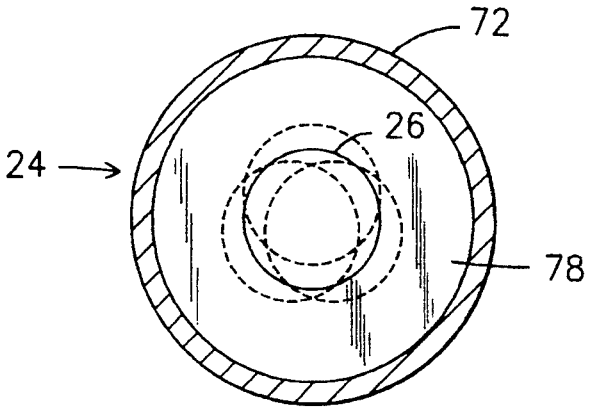
FIG. 4 is a cross-sectional top view of the mixing device of the present invention taken along line 4—4 of FIG. 3.

As best shown in FIGS. 1, 3 and 4, the upper container limit 24 comprises a cover generally indicated as 64 including a lower annular enlarged substantially vertical skirt 66 with an annular lip 68 extending downwardly therefrom to selectively engage the inner surface of the upper portion of the substantially vertical cylindrical lower limit member 58 to operatively secure or mount the upper container limit 24 to the lower container limit 20 and an upper cap generally indicated as 70 including a reduced upper annular substantially vertical wall 72 extending upwardly from the upper portion of the lower annular enlarged substantially vertical skirt 66 with a substantially horizontal lip 74 with a centrally disposed aperture 76 formed therethrough extending inwardly therefrom with a substantially vertically disposed upper resilient ring or annular member 78 including a centrally disposed channel 80 having a diameter less than the diameter of the centrally disposed aperture 76 to receive the upper portion 26 of the liquid container 12.

The lower container limit 20 and upper container limit 24 cooperatively form a lateral limit means to restrict movement of the enlarged lower portion 22 and reduced upper portion 26 of the liquid container 12 respectively. Both the substantially vertically disposed lower resilient ring or annular member 60 and substantially vertically disposed upper resilient ring or annular member 78 are constructed of resilient foam or rubber material. The substantially vertically disposed upper resilient ring or annular member 78 is softer or less dense than the substantially vertically disposed lower resilient ring or annular member 60 whereby the enlarged lower portion 22 is more confined than the reduced upper portion 26 such that the reduced upper portion 26 moves or translates laterally further from the vertical axis A that the enlarged lower portion 22 to shake the liquid container 12 as the rotational drive means 18 rotates the container support 16.

To use, the cover 64 is removed from the lower container limit 20 to allow placement of the enlarged lower portion 22 of the liquid container 12 to be placed in the centrally disposed channel 62. When so positioned, the cover 64 is placed on the lower container limit 20 with the reduced upper portion 26 of the liquid container 12 disposed within the centrally disposed channel 80.

In use, the switch 50 is moved to the on position so that the rotational drive means rotates the container support 16 and liquid container 12. The lower container limit 20 engages the enlarged lower portion 22 of the liquid container 12 and the upper container limit 24 to engage the reduced upper portion 26 of the liquid container 12 such that as the container support 16 is rotated about the vertical axis A movement of the enlarged lower portion 22 and reduced upper portion 26 of the liquid container 12 laterally from the vertical axis A as depicted by lines B is limited to create a wobbling motion to shake and spin the liquid container 12 to thoroughly and rapidly mix the liquid.

Although a single liquid container cavity is shown, a multiple cavity support platform would permit a plurality of liquid containers 12 to be mixed simultaneously.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A mixing device for mixing at least one liquid container containing liquid therein comprising a housing including a lower portion having a container support to support the liquid container thereon disposed in said lower portion thereof and coupled to a rotational drive means to rotate said container support and a lateral limit means to engage the liquid container as said container support is rotated such that the liquid container translates laterally from the vertical axis to engage said lateral limit means to create a wobbling motion to shake and spin the liquid container to thoroughly and rapidly mix the liquid therein, said lateral limit means comprises a lower container limit including a substantially vertical cylindrical lower limit member extending upwardly from a substantially horizontal support platform disposed in spaced relationship relative to a centrally disposed support member and a substantially vertical disposed lower resilient ring member including a centrally disposed channel to receive the lower portion of the liquid container disposed between said substantially vertical cylindrical lower limit member and said centrally disposed support member and an upper container limit including a cover including a lower annular enlarged substantially vertical skirt with an annular lip extending downwardly therefrom to selectively said inner surface of said upper portion of said substantially vertical cylindrical lower limit member to operatively mount said upper container limit to said lower container limit and an upper cap including a reduced upper annular substantially vertical wall extending upwardly from the upper portion of said lower annular enlarged substantially vertical skirt with a substantially horizontal lip with a centrally disposed aperture formed therethrough extending inwardly therefrom with a substantially vertically disposed upper resilient ring member including a centrally disposed channel having a diameter less than the diameter of said centrally disposed aperture to receive the upper portion of the liquid container.

2. The mixing device of claim 1 wherein said substantially vertically disposed upper resilient ring member is less dense than said substantially vertically disposed lower resilient ring member whereby movement of the lower portion of the liquid container is more restricted than the upper portion of the liquid container.

3. A mixing device for mixing at least one liquid container containing liquid therein comprising a housing including a lower portion having a container support therein to support the liquid container thereon disposed in said lower portion thereof and coupled to a rotational drive means to rotate said container support and a lateral limit means to engage the liquid container as said container support is rotated such that the liquid container translates laterally from the vertical axis to engage said lateral limit means to create a wobbling motion to shake and spin the liquid container to thoroughly and rapidly mix the liquid therein, said lateral limit means comprises a lower container limit to engage the lower portion of the liquid container and an upper container limit to engage the upper portion of the liquid container, said upper container limit comprises an upper limit member mounted on said housing and said upper container limit further includes an upper resilient ring member including a centrally disposed channel to receive the upper portion of the liquid container.

4. The mixing device of claim 3 wherein said lower container limit comprises a lower limit member extending upwardly from said container support.

5. The mixing device of claim 4 wherein said lower container limit further includes a lower resilient ring member disposed within said lower limit member and including a centrally disposed channel to receive the lower portion of the liquid container.

6. The mixing device of claim 3 wherein said lower container limit comprises a lower resilient ring member including a centrally disposed channel to receive the lower portion of the liquid container.

7. The mixing device of claim 6 wherein said lower container limit further includes a lower limit member extending upwardly from said container support to retain said lower resilient ring member.

8. A mixing device for mixing at least one liquid container containing liquid therein comprising a housing including a lower portion having a container support to support the liquid container thereon disposed in the lower portion thereof and coupled to a rotational drive means to rotate said container support and a lateral limit means to engage the liquid container as said container support is rotated such that the liquid container translates laterally from the vertical axis to engage said lateral limit means to create a wobbling motion to shake and spin the liquid container to thoroughly and rapidly mix the liquid therein, said lateral limit means comprises a lower container limit to engage the lower portion of the liquid container and an upper container limit to engage the upper portion of the liquid container, said upper container limit comprises an upper resilient ring including a centrally disposed channel to receive the upper portion of the liquid container.

9. The mixing device of claim 8 wherein said lower container limit comprises a lower limit member extending upwardly from said container support.

10. The mixing device of claim 9 wherein said lower container limit further includes a lower resilient ring member disposed within said lower limit member and including a centrally disposed channel to receive the lower portion of the liquid container.

11. The mixing device of claim 8 wherein said lower container limit comprises a lower resilient ring member including a centrally disposed channel to receive the lower portion of the liquid container.

12. The mixing device of claim 11 wherein said lower container limit further includes a lower limit member extending upwardly from said container support to retain said lower resilient ring member.

13. The mixing device of claim 8 wherein said upper container limit further includes an upper limit member mounted on said housing to retain said upper resilient ring member.

14. A mixing device for mixing at least one liquid container containing liquid therein comprising a housing including a lower portion having a container support to support the liquid container thereon disposed in said lower portion thereof and coupled to a rotational drive means to rotate said container support and a lateral limit means to engage the liquid container as said container support is rotated such that the liquid container translates laterally from the vertical axis to engage said lateral limit means to create a wobbling motion to shake and spin the liquid container to thoroughly and rapidly mix the liquid therein, said lateral limit means comprises a lower container limit and upper container limit to restrict movement of the lower portion of the liquid container and upper portion of the liquid container respectively and said lower container limit comprises a lower resilient ring member including a centrally disposed channel to receive the lower portion of the liquid container and said upper container limit comprises an upper resilient ring member including a centrally disposed channel to receive the upper portion of the liquid container.

15. The mixing device of claim 14 wherein said lower container limit further includes a lower limit member extending upwardly from said container support to retain said lower resilient ring member and an upper container limit member mounted on said housing to retain said upper resilient ring member.

16. The mixing device of claim 14 wherein said upper resilient ring member is less dense than said lower resilient ring member whereby movement of the lower portion of the liquid container is more restricted than the upper portion of the liquid container.

17. A mixing device for mixing at least one liquid container containing liquid therein comprising a housing including a lower portion having a container support to support the liquid container thereon disposed in said lower portion thereof and coupled to a rotational drive means to rotate said container support and a lateral limit means to engage the liquid container as said container support is rotated such that the liquid container translates laterally from the vertical axis to engage said lateral limit means to create a wobbling motion to shake and spin the liquid container to thoroughly and rapidly mix the liquid therein, said lateral limit means comprises a lower container limit and upper container limit to restrict movement of the lower portion of the liquid container and upper portion of the liquid container respectively and said lower container limit comprises a vertical lower limit member extending upwardly from said container support and said upper container limit comprises an upper container limit member mounted on said housing.

18. The mixing device of claim 17 wherein said lower containment limit further includes a lower resilient ring member including a centrally disposed channel to receive the lower portion of the liquid container and said upper container limit further includes an upper resilient ring member including a centrally disposed channel to receive the upper portion of the liquid container.

19. The mixing device of claim 18 wherein said upper resilient ring member is less dense than said lower resilient ring member whereby movement of the lower portion of the liquid container is more restricted than the upper portion of the liquid container.

20. A mixing device for mixing at least one liquid container containing liquid therein comprising a housing having a container support to support the liquid container thereon disposed in said lower portion thereof and coupled to a rotational drive means to rotate said container support and a lateral limit means to engage the liquid container as said container support is rotated such that the liquid container translates laterally from the vertical axis to engage said lateral limit means to create a wobbling motion to shake and spin the liquid container to thoroughly and rapidly mix the liquid therein, said lateral limit means comprises a lower container limit and upper container limit to restrict movement of the lower portion of the liquid container and upper portion of the liquid container respectively, said container support comprises a substantially horizontal support platform, said lower container limit comprises a substantially vertical lower limit member extending upwardly from said substantially horizontal support platform disposed in spaced relationship, said upper container limit comprises a cover including a lower enlarged substantially vertical skirt with an annular lip extending downwardly therefrom to selectively engage the inner surface of the upper portion of said substantially vertical lower limit member to operatively mount said upper container limit to the lower-container limit and an upper cap including a reduced upper annular substantially vertical wall extending upwardly from the upper portion of said lower substantially vertical skirt with a substantially horizontal lip with a centrally disposed aperture formed therethrough extending inwardly therefrom.

21. The mixing device of claim 20 wherein said lower container limit comprises a lower resilient ring member including a centrally disposed channel to receive the lower portion of the liquid container and said upper container limit comprises an upper resilient ring member including a centrally disposed channel to receive the upper portion of the liquid container.

22. The mixing device of claim 21 wherein said upper resilient ring member is less dense than said lower resilient ring member whereby movement of the lower portion of the liquid container is more restricted than the upper portion of the liquid container.

* * * * *